US009901518B1

(12) United States Patent
Denisco et al.

(10) Patent No.: US 9,901,518 B1
(45) Date of Patent: Feb. 27, 2018

(54) FLUID DISPENSING MECHANISM

(71) Applicants: Carmine Denisco, Odessa, FL (US); Rick Valderrama, Seminole, FL (US)

(72) Inventors: Carmine Denisco, Odessa, FL (US); Rick Valderrama, Seminole, FL (US)

(73) Assignee: InventorsLaunchpad.com, Tampa, FL (US)

( * ) Notice: Subject to any disclaimer, the term of this patent is extended or adjusted under 35 U.S.C. 154(b) by 0 days.

(21) Appl. No.: 15/283,253

(22) Filed: Sep. 30, 2016

(51) Int. Cl.
*A61J 11/00* (2006.01)
*A61J 9/00* (2006.01)
*A61J 11/04* (2006.01)

(52) U.S. Cl.
CPC ..... *A61J 11/0095* (2013.01); *A61J 9/005* (2013.01); *A61J 11/008* (2013.01); *A61J 11/04* (2013.01)

(58) Field of Classification Search
CPC ..... A61J 11/0095; A61J 9/005
USPC ..... 215/11.1–11.6; 426/117; 220/714
See application file for complete search history.

(56) References Cited

U.S. PATENT DOCUMENTS 3,519,157 A * 7/1970 Meierhoefer ..... A61J 11/0095 215/11.6
3,635,724 A * 1/1972 Schaar ..... A61J 11/008 215/11.6

OTHER PUBLICATIONS

Office Action for similar-related application.

* cited by examiner

*Primary Examiner* — Anthony Stashick
*Assistant Examiner* — Raven Collins
(74) *Attorney, Agent, or Firm* — Chris Tanner, Esq.; TannerPatent.com

(57) ABSTRACT

An improved apparatus, system, and method for assisting in feeding a baby is desired. A device included within this system can be made in a variety of beneficial shapes and sizes, including being configurable to be operable with only one hand.

19 Claims, 13 Drawing Sheets

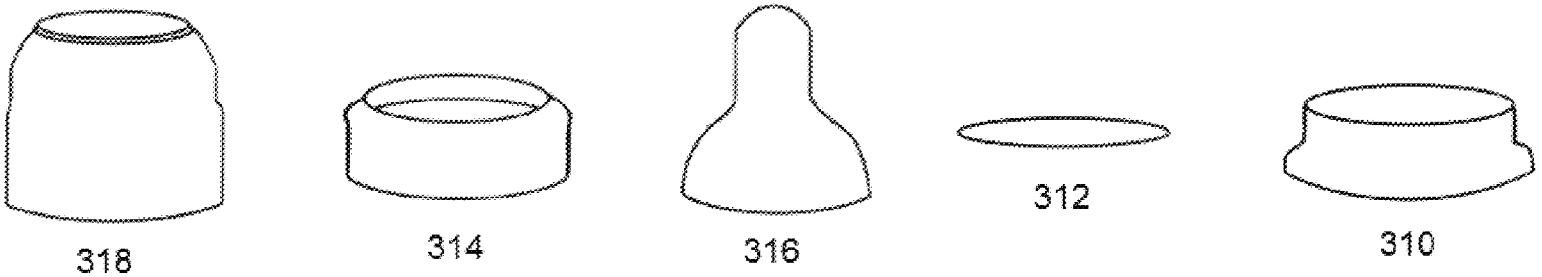
FIG. 3B (simplified\skeletal views)

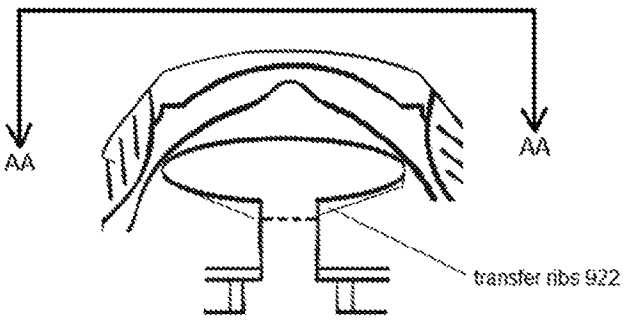
FIG. 9G
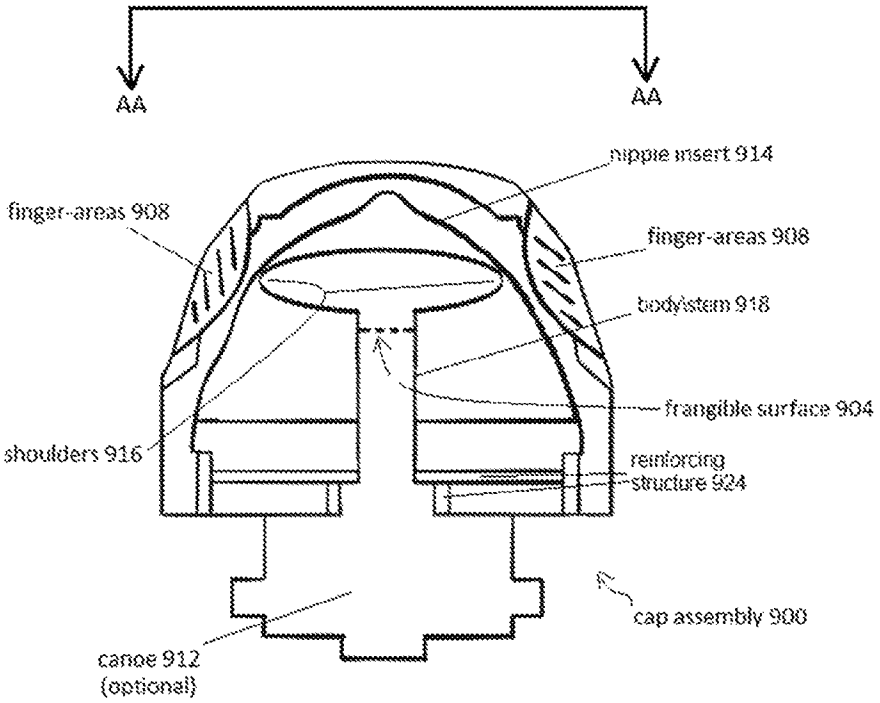
FIG. 9F (not limiting, frangible surface 904 can be located other than where shown)

FLUID DISPENSING MECHANISM

BACKGROUND

There can be instances where a person is trying to feed a baby and has limited use of one or both hands. For at least the above reasons, an improved apparatus, system, and method for assisting in feeding a baby is desired, including operating a baby bottle with one hand.

BRIEF DESCRIPTION OF DRAWINGS

A variety of views of various embodiments are provided herewith.

FIGS. 3A-B show separated views of the embodiment of FIGS. 1-2;

FIGS. 9A-9G show various alternate embodiments.

DETAILED DESCRIPTION OF PREFERRED EMBODIMENTS

This disclosure will be divided into the following sections.

STRUCTURAL COMPONENTS AND HOW THEY INTERRELATE

METHOD OF MANUFACTURE OF COMPONENT PARTS

ILLUSTRATED ORDER OF BUILDING\PACKAGING THE CAP ASSEMBLY 100

ILLUSTRATED METHOD OF USE

Structural Components and how they Interrelate

Figure 1:
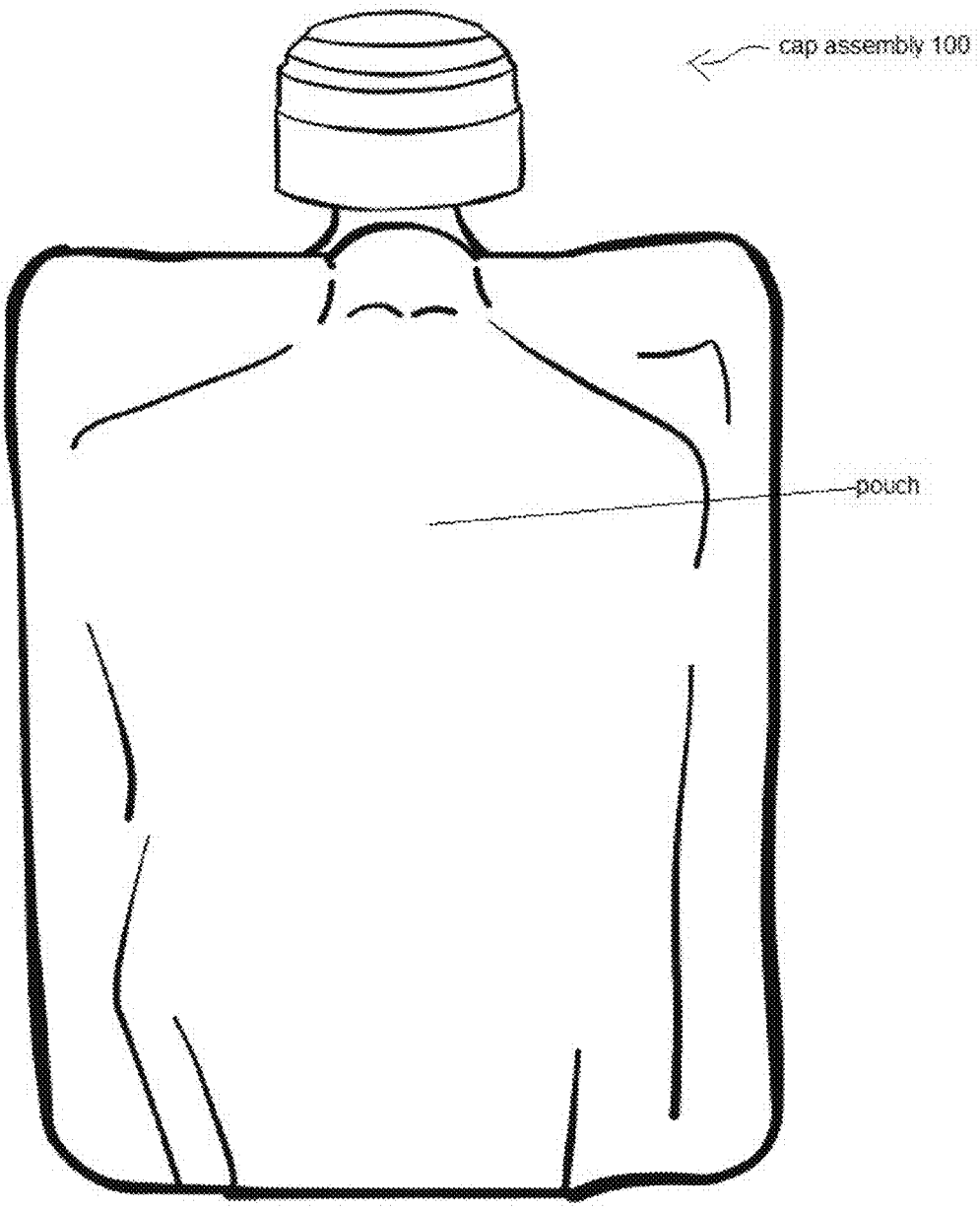
FIG. 1 shows a baby bottle fitted with an embodiment of the inventions disclosed herein.
Figure 2A:
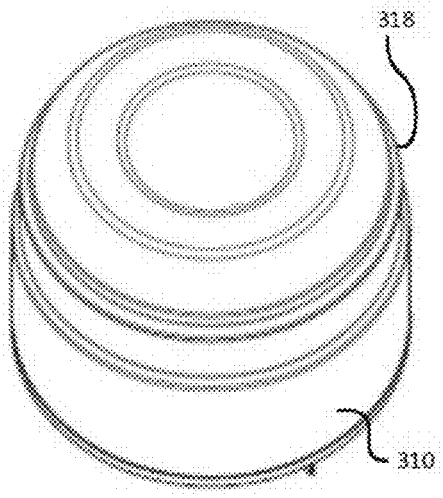
FIGS. 2A-2F show more detail of the embodiment of FIG. 1.
Figure 2B:
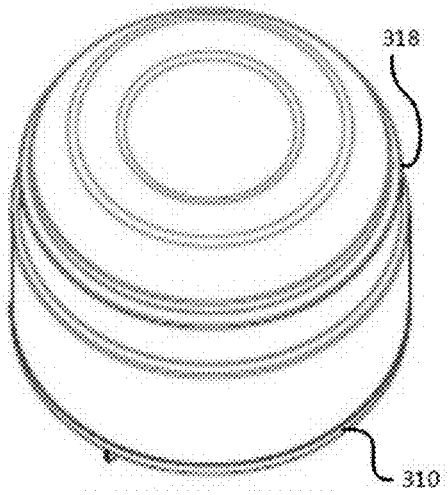
Figure 2C:
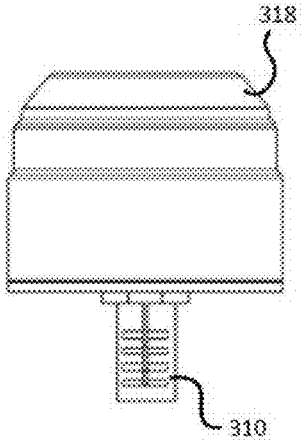
Figure 2D:
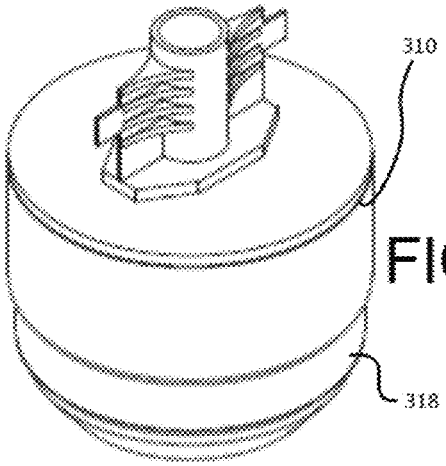
Figure 2E:
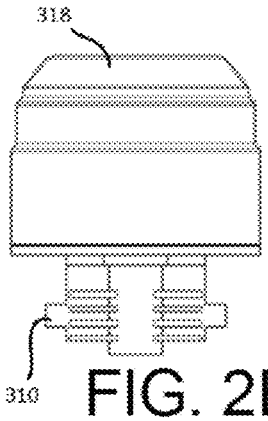
Figure 2F:
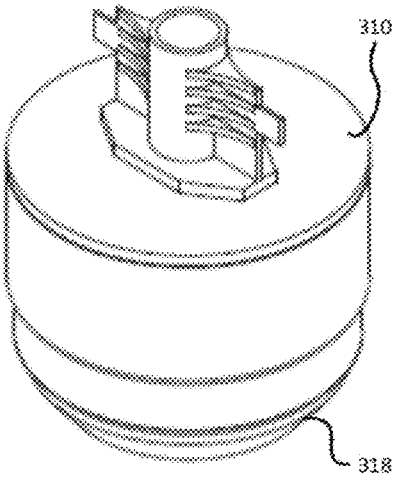

FIG. 1 shows a baby bottle fitted with the cap assembly 100 of the present invention.

FIGS. 2A-2F show an embodiment of the cap assembly 100, in which a fitting 310 and an outer cap 318 are shown.

Figure 3A:
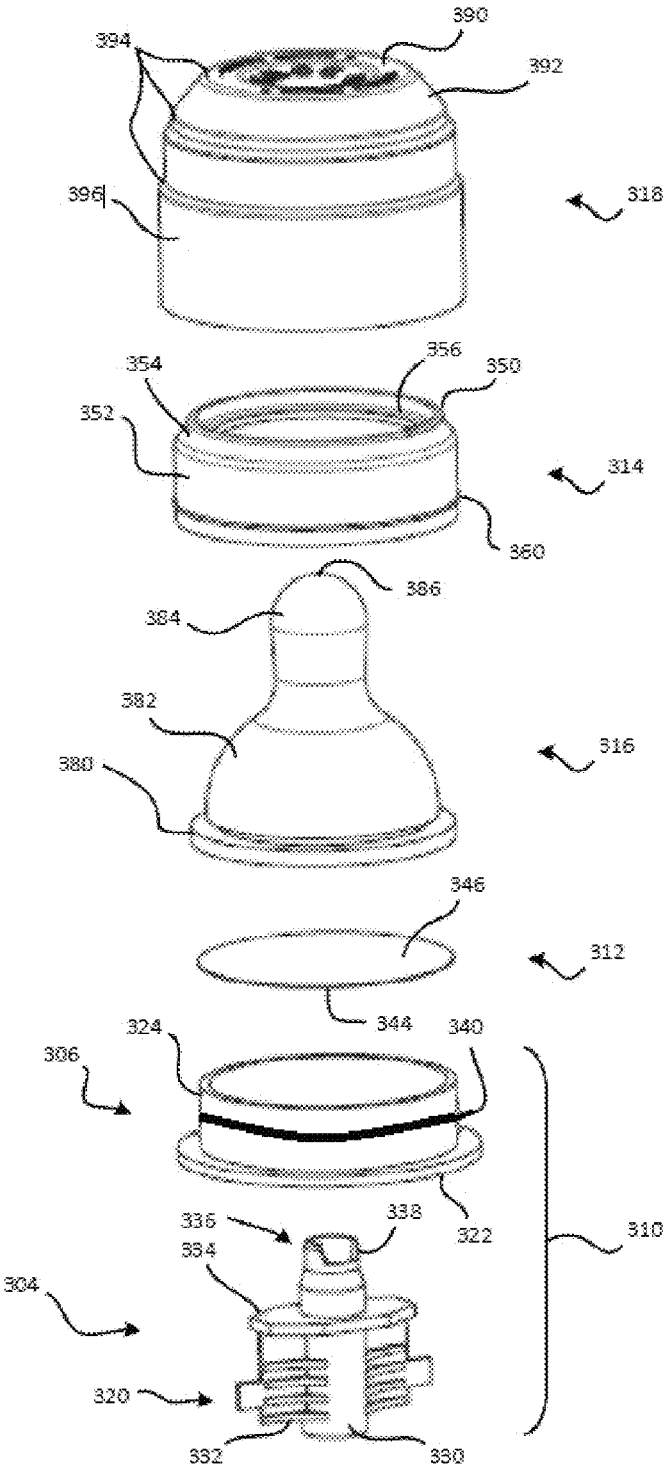

FIGS. 3A-B show separated views of various components of the cap assembly 100. The cap assembly 100 has the fitting 310, a seal 312, a gripping ring 314, a nipple insert 316, and the outer cap 318. When in the closed position, the outer cap 318 may generally cover and contain the other components of the cap 100 with the exception of the fitting 310.

Figure 4A:
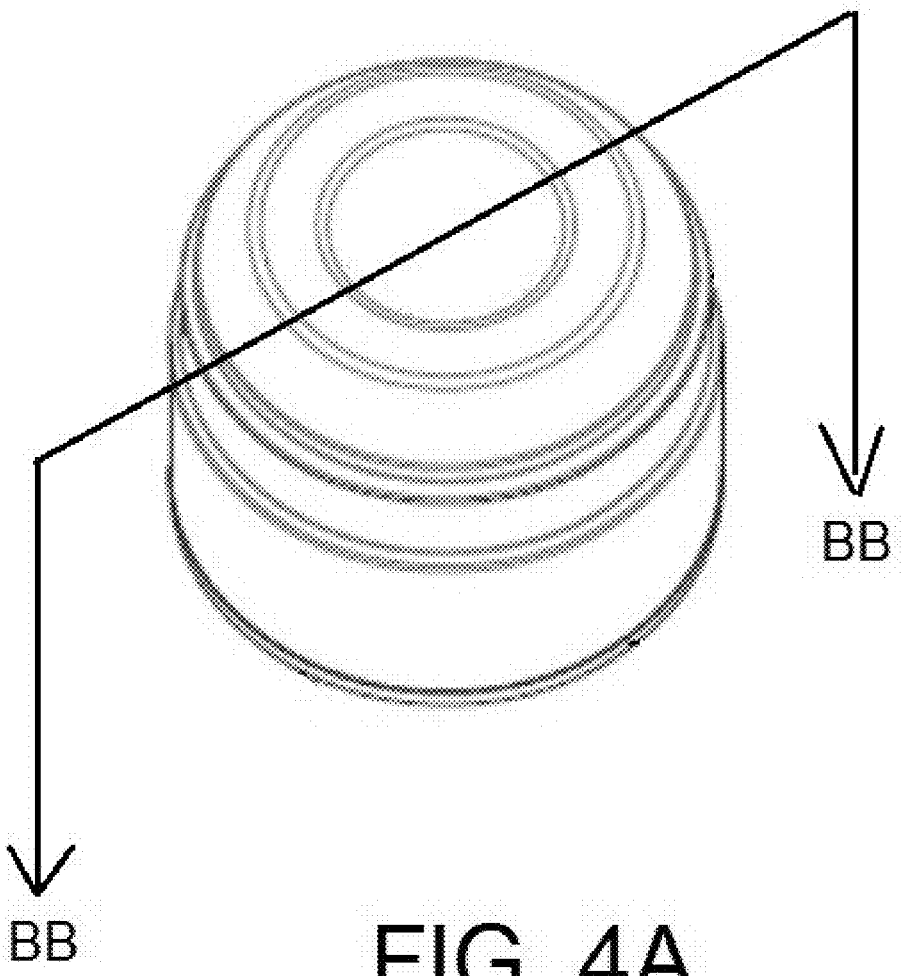
FIG. 4A shows the embodiment of FIGS. 1-3 having a cutaway-line BB-BB.
Figure 4B:
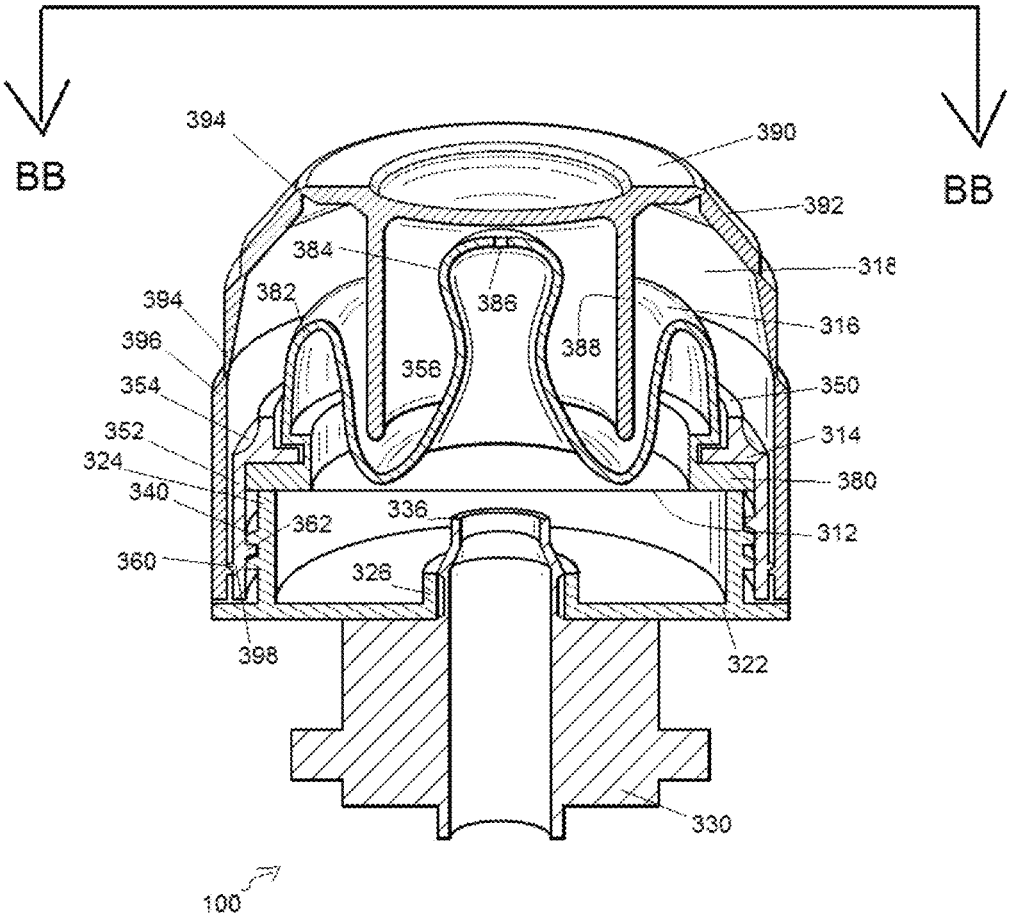
FIG. 4B is an interior sectioned view of the embodiment of FIGS. 1-3 cut along the cutaway-line BB-BB.

FIGS. 4A and 4B shows the cap 100 in a fully-assembled state, with FIG. 4B being a cut-away interior view along the cutaway-line BB-BB shown in FIG. 4A.

In FIGS. 4A-4B, the cap assembly 100 is shown in a configuration suitable for transportation or storage. When in the closed position, the outer cap 318 may generally cover and contain the other components of the cap 100 with the exception of the fitting 310.

The fitting 310 has two separate pieces, a canoe portion 304 and a base portion 306. The canoe portion 304 has a pouch attachment 320 that is attachable to a pouch, such as but not limited to the pouches shown in FIGS. 1, 5 and 6.

The pouch attachment fitting 320 has a post 330, which is tubular in shape so as to allow the fluid 130 to flow through the post 330 from an interior cavity. The pouch attachment fitting 320 may also have a plurality of ribs 332, which may protrude outward from the post 330. The ribs 332 have a tapered shape to present a smooth surface to the pouch. The ribs 332 may present several such surfaces to the throat of the pouch so as to increase the likelihood of obtaining a hermetic seal when all of the ribs 332 are secured to the throat.

The canoe portion 304 may also have a flange 334, which abuts the base portion 306 when the canoe portion 304 and the base portion 306 are secured together. The base portion 306 has a base 322, a first exterior tube 324, and an interior tube 326. In an embodiment, an adhesive, weld, press fit, or other attachment mechanism is used to secure the flange 334 and/or the adjoining portion of the post 330 to the base portion 306.

The post 330 has a puncture section 336 received by the base portion 306. It is desired to avoid excessive force in puncturing the seal 312. That is, it is desired to puncture the seal 312, rather than rip it by the outer edges. To achieve this, certain portions of the puncture section 336 are made sharper and pointier, using a variety of formations. For example, as shown in FIG. 4A, the puncture section 336 can be angled, and/or having serrations, and/or ridges. The specific geometry chosen will depend on the type of materials used for the seal 312, along with manufacturing costs, space considerations, and behavior during shipping and testing of the overall products which use the cap assembly 100 in an as-sold embodiment.

The base 322 is disc-shaped with a diameter significantly larger than that of the post 330. The first exterior tube 324 has an exterior ridge 340, which pops in and out of the gripping ring 314, making an audible sound in either direction, thereby letting the user know that the seal and sanitary conditions are proper and in-place. The various fibers and adhesives within the seal 312 can be chosen on their ability to make an audible popping noise when punctured. It is also possible to load the infant formula into the vessel (e.g. tube, pouch, box, see FIG. 5) at a slightly higher pressure.

The interior tube 326 is located within the first exterior tube 324 and is nearly the same length, but slightly shorter. The first exterior tube 324 and the interior tube 326 each have an exposed rim; the two rims are nearly coplanar to each other.

The seal 312 has an interior side 344 and an exterior side 346. The seal 312 is not rigid, but instead is a pliable membrane that can be easily secured, at the interior side 344, to the exposed rim of the first exterior tube 324 and/or the exposed rim of the interior tube 326. The seal 312 is formed of a polymer, metal foil, paper, or any other material that can be readily attached to the fitting 310 to form a proper seal, and yet be readily ruptured by the puncture section 336.

In embodiment, the interior side 344 of the seal 312 is attached only to the exposed rim of the first exterior tube 324. Further, a small gap exists between the interior side 344 of the seal 312 and the puncture surface 336 to help ensure that the seal 312 is not inadvertently punctured during filling, assembly, storage, or transportation.

The gripping ring 314 has a rim 350, a second exterior tube 352, a shoulder 354, and an interior flange 356. The rim 350 may protrude upward and may, in the assembled configuration, generally encircle the nipple insert 316, which is retained in place by the interior flange 356. The shoulder 354 extends inward from the distal end of the second exterior tube 352 to join the rim 350. Thus, the rim 350 has a diameter smaller than that of the exterior tube 352. The gripping ring 314 are attachable to the fitting 310 such that the second exterior tube 352 fits around the first exterior tube 324.

The second exterior tube 352 has a locking ridge 360 that extends outward. The locking ridge 360 has a wedge-like shape, and snaps into engagement with a corresponding locking ridge of the outer cap 318. Additionally, the second exterior tube 352 has an interior thread 362, which may extend inward toward the first exterior tube 324. The interior thread 362 may interface with the exterior ridge 340 so that the second exterior tube 352 threads into engagement with the first exterior tube 324.

As will be discussed in more detail below, to assemble the fitting 310 and the gripping ring 314, the gripping ring 314 is inserted over the fitting 310 and rotated, for example, clockwise when viewed from the top, to cause the interior thread 362 of the second exterior tube 352 to engage the ridge 340 of the first exterior tube 324.

The nipple insert 316 has a retention flange 380, a dome 382, and a nipple 384. If desired, the nipple insert 316 are the same as or similar to a convention nipple used in a baby's bottle or the like. The nipple insert 316 are formed of an elastomer such as rubber or silicone rubber. The nipple 384 has a hole 386 through which fluid is able to exit the interior of the nipple insert 316.

The retention flange 380 is captured between the distal edge of the first exterior tube 324 of the base portion 306 and the interior flange 356 of the gripping ring 314. Thus, when the gripping ring 314 is positioned onto the fitting 310 with the nipple insert 316 in place, the nipple insert 316 is effectively captured. The dome 382 may flex into an inverted state such that the nipple insert 316 assumes a more compact configuration that fits within the outer cap 318 until the cap assembly 100 is to be used.

The outer cap 318 has a surface 390 and a shoulder 392 that extends from the surface 390 and separated by flex-hinges 394. The flex-hinges 394 move from their rest-position when the surface 390 is pressed toward the remainder of the cap assembly 100. An interior wall 388 may extend toward the nipple insert 316 from the distal surface 390.

An annular wall 396 extends toward the fitting 310 from the shoulder 392. The interior surface of the annular wall 396 are slightly larger than the exterior surface of the second exterior tube 352 of the gripping ring 314, so that the annular wall 396 fits over the second exterior tube 352.

The annular wall 396 has a locking ridge 398 that protrudes inward. The locking ridge 398 has a wedge-like shape similar to that of the locking ridge 360. The locking ridge 398 is sized to interfere slightly with the locking ridge 360 so that, as the outer cap 318 is inserted onto the gripping ring 314, the locking ridge 398 and/or the locking ridge 360 flatten slightly and then snap into a position in which they interfere with each other. Thus, the outer cap 318 is held in place on the remainder of the cap 100 until the user exerts pressure on the outer cap 318 to remove it, thereby disengaging the locking ridge 398 from the locking ridge 360.

The outer cap 318 may therefore cover the gripping ring 314 and enclose the nipple insert 316, thereby protecting the interior of the cap 100 from dust or other contaminants. The outer cap 318 may remain securely in place on the gripping ring 314 during transportation and/or storage of the cap 100.

As the outer cap 318 is inserted onto the gripping ring 314, the interior wall 388 abuts the dome 382 and urges the dome 382 to assume the inverted configuration. Thus, the nipple insert 316 is compacted automatically as the outer cap 318 snaps into engagement with the gripping ring 314. In the fully-assembled state, the outer cap 318 abuts the base 322 to ensure that the interior wall 388 does not advance too far and prematurely rupture the seal 312.

Figure 5:
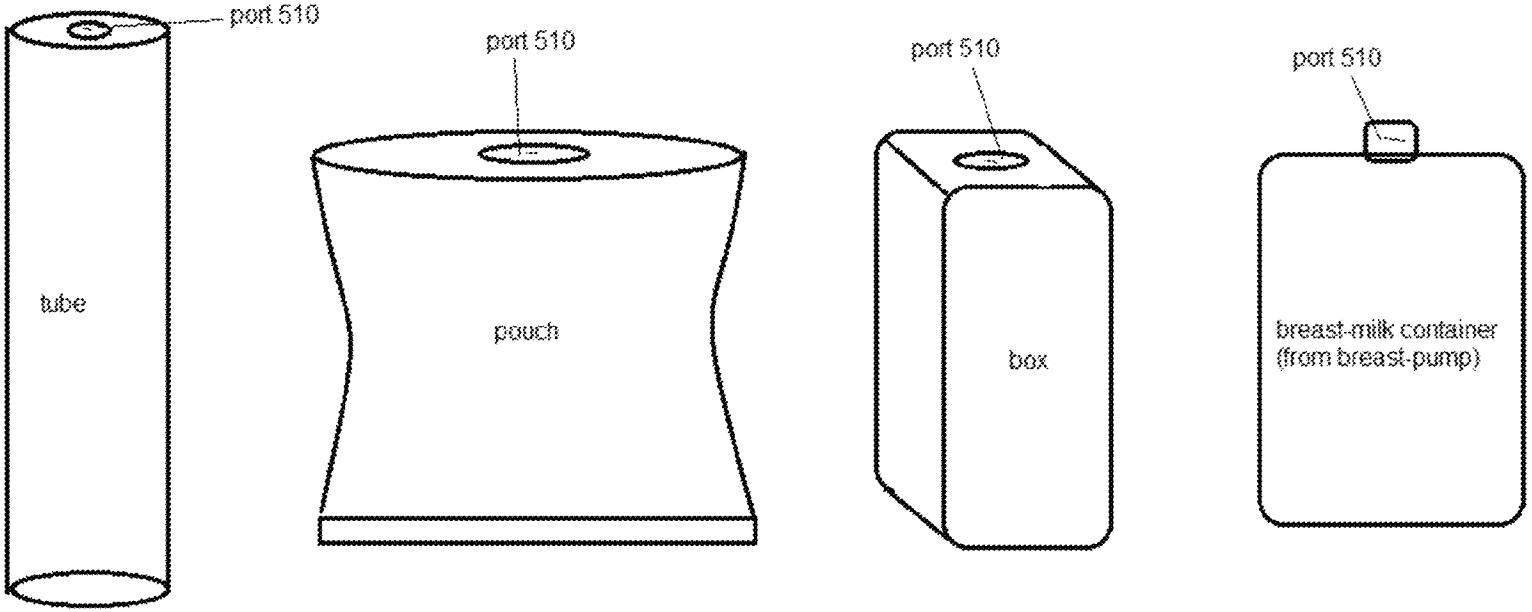
FIG. 5 shows an arrangement of vessels to which the embodiments can be attached.

Baby formula, and also natural breast milk, can be either purchased or stored in a variety of containers, including but not limited to pouch, tube, or box, or breast-pump container. Examples of these containers are shown in FIG. 5. All containers have a port 510.

Figure 6:
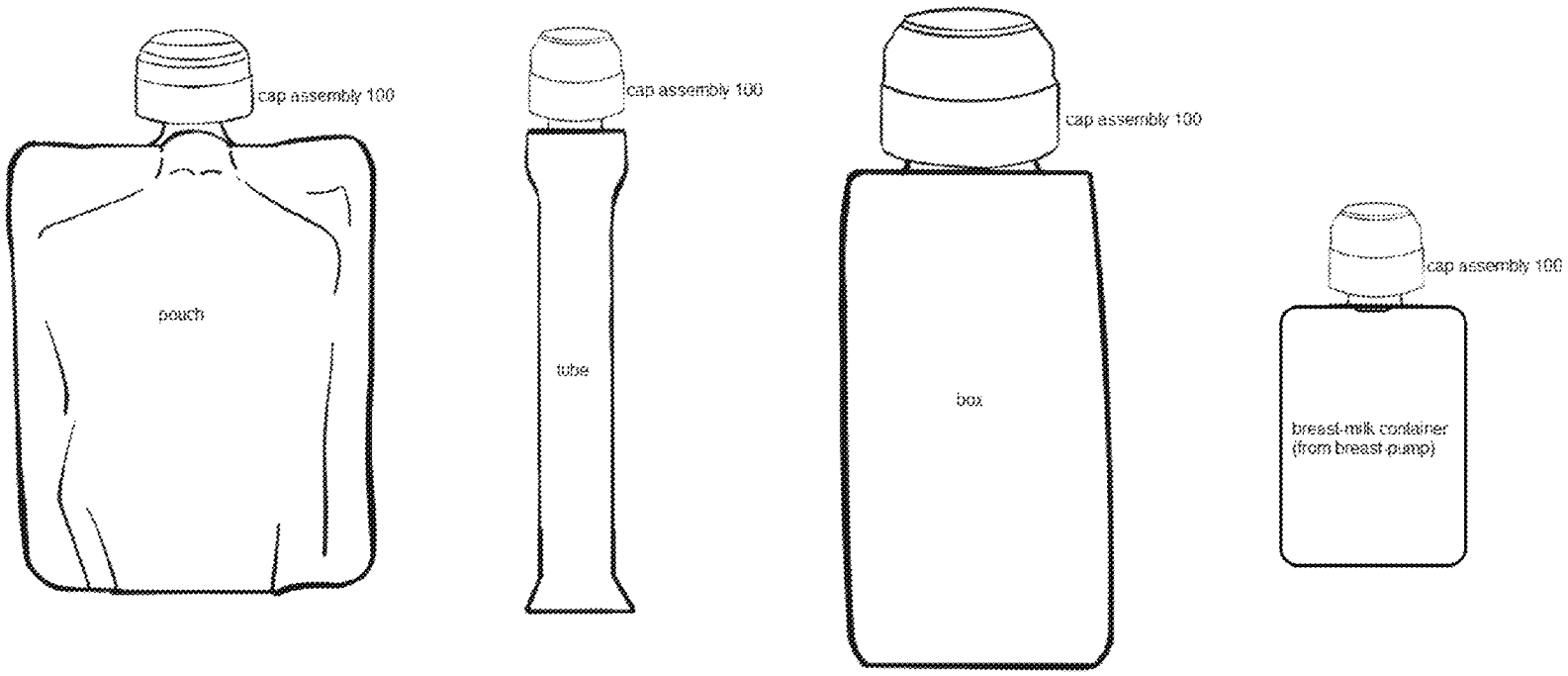
FIG. 6 shows the vessels of FIG. 5 having embodiments attached thereto.

FIG. 6 shows how the cap assembly 100 is used in connection with other components as shown and described in FIG. 5, such as the pouch, tube, or box, or breast-pump container.

Figure 7:
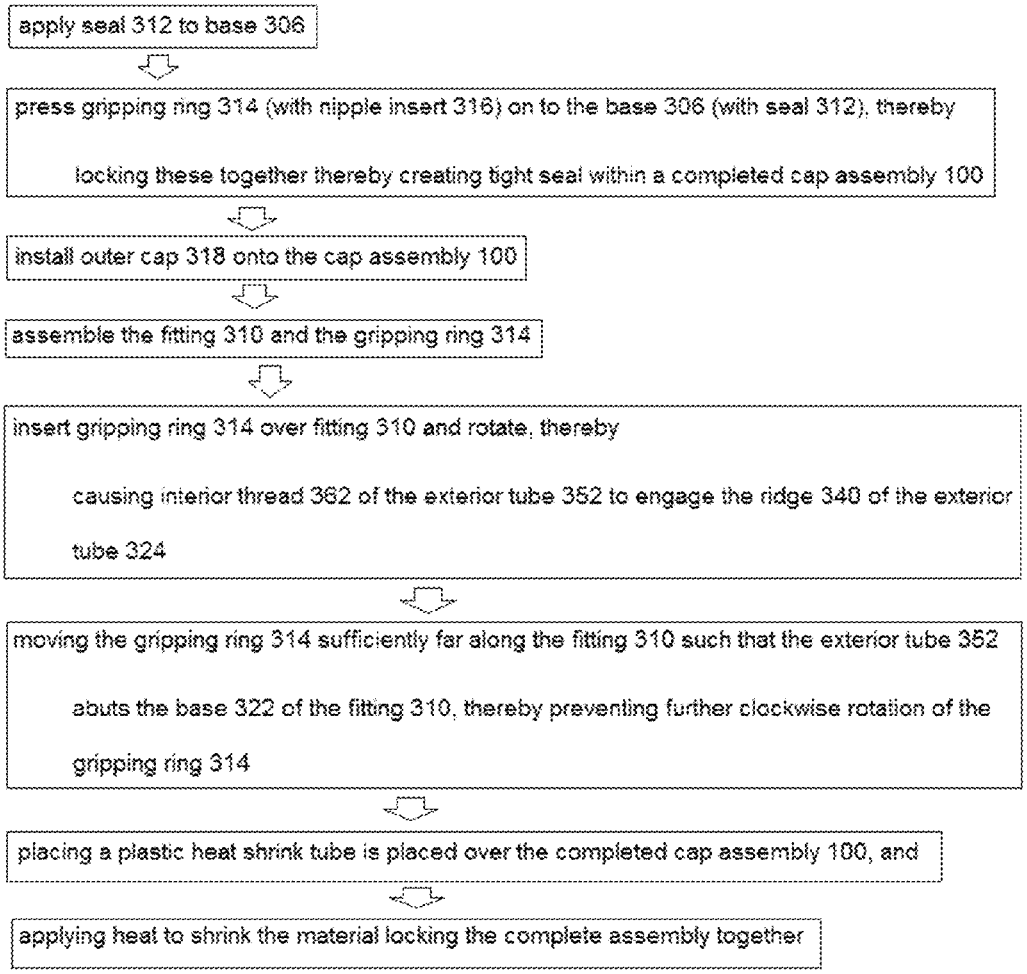
FIGS. 7 and 8 show methods of manufacture.
Figure 8:
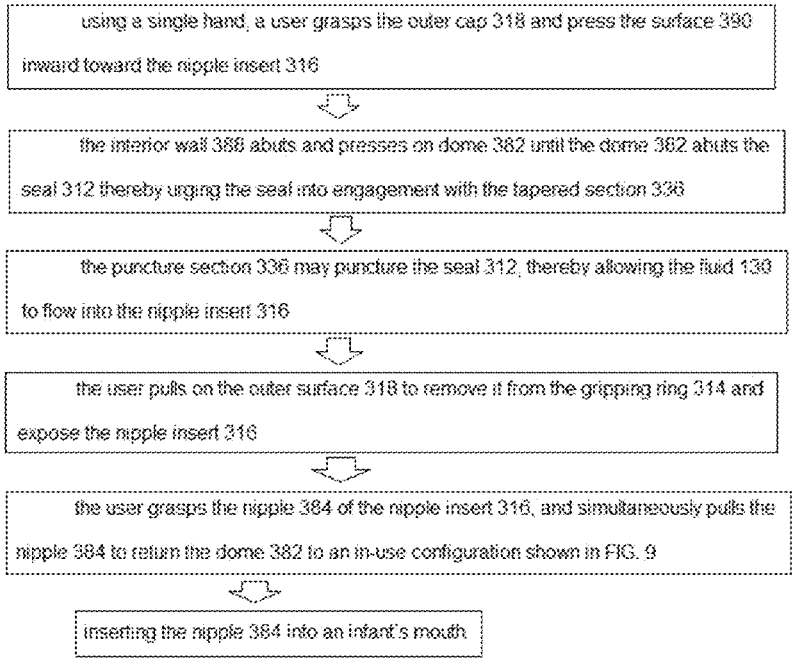

FIGS. 7 and 8 show example methods of manufacture and use of the cap assembly 100, respectively.

Figure 9D:
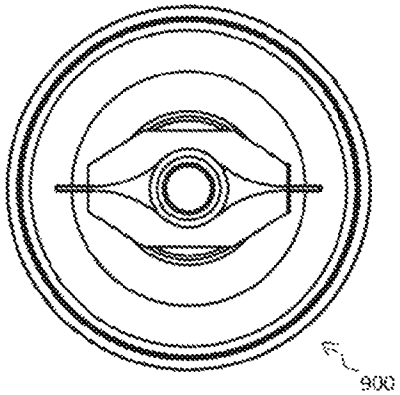

FIGS. 9A-9G show an alternate embodiment cap assembly 900. Within the embodiment of FIGS. 9A-9G, there is no seal or other part resembling the earlier seal 312. Instead, a frangible surface 904 is implemented. Within the cap assembly 900, various other parts present in the cap assembly 100 are not present in the cap assembly 900, although others are included. To clarify this, FIG. 9D shows a bottom-view of the cap-assembly 900 having a canoe 912 attached, but this canoe 912 is optional and is not required.

Specifically, like the cap assembly 100, the cap assembly 900 is intended to be applied to a vessel with a fitting having a cylindrical outer surface, and will comprise a cylindrical gripping ring which attaches to the fitting via snap-fit; a nipple insert located between the gripping ring and the fitting such that the gripping ring holds the nipple insert to be immobile and non-movable; and an outer cap, wherein the outer cap has a tapered cylindrical shape and is attached to the fitting such that the outer cap entirely covers the circular seal, cylindrical gripping ring, and nipple insert.

Further, the cap assembly 900 may also comprise a canoe portion and a base portion, wherein the canoe portion has a vertical surface which is inserted into an aperture formed within a bottom of the base portion.

Still further, the cylindrical gripping ring further comprises a rim, exterior tube, shoulder, and interior flange, wherein the rim encircles the nipple insert and the interior flange retains the nipple insert in place.

Figure 9C:
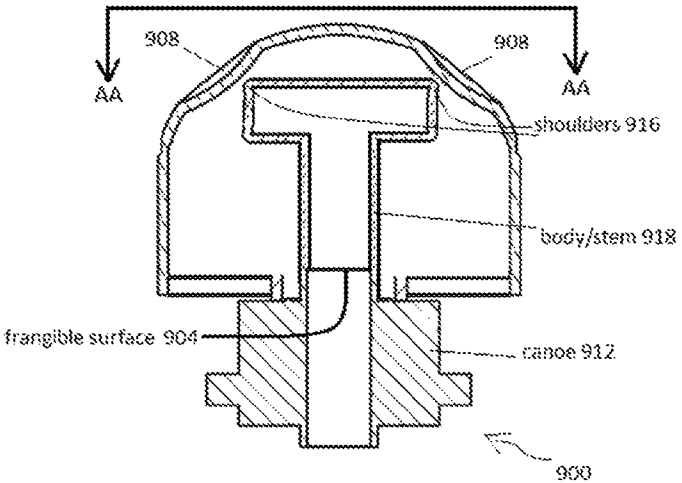
Figure 9E:
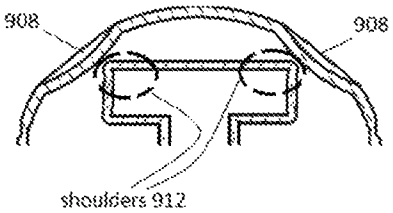
Figure 9A:
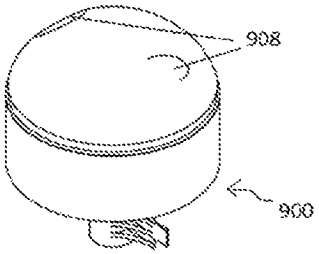
Figure 9B:
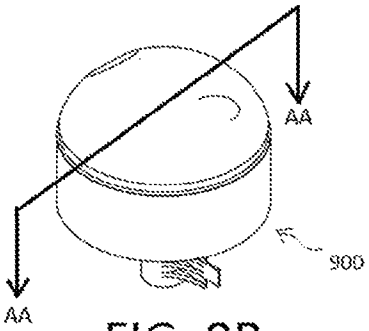

FIGS. 9A-9G show the cap assembly 900 in various views. FIG. 9A is a view of the external structure of the cap assembly 900. FIG. 9B shows the cap assembly 900 with cut-lines AA-AA, while FIG. 9C shows an interior cut-away view of the cap assembly 900 as cut along the lines AA-AA. For simplicity, FIGS. 9C and 9F are abbreviated to convey the main principles of the invention, particularly the interaction between the shoulders 916 and finger-areas 908. FIG. 9D shows a bottom-view of the cap assembly 900 with the (optional) canoe 912 included. FIG. 9E shows more detail about the shoulders 916.

Within FIGS. 9A-9G, finger-areas 908 are shown. A user will grip these finger-areas 908, likely with a thumb and one other finger, and use the finger-areas 908 to apply pressure to the cap assembly 900. This pressure will be transferred to the shoulders 916, as shown in FIG. 9C.

In the cap assembly 900 of FIGS. 9A-9G, the thumb-part of the finger-surface will crack the base at a predetermined joint, known as a frangible surface 904. The frangible surface 904 is manufactured to be secure during manufacturing, filling, and shipping, but brittle and crackable during use. However, the cap-assembly is mechanically arranged such that the crackability is achieved only where pressure is applied to the finger-areas 908 (and the shoulders 916) in a way that corresponds with pressure from human fingers, and not from ordinary stresses of shipping, packaging, and being boxed and transported. At such time as a user elects, and only at this time, the frangible surface 904 lends itself to being ruptured and/or fractured when mechanical force is applied to the shoulders 916.

Within the embodiments shown in FIG. 9C, this mechanical force is then transferred through the body\stem 918 and exerted on the frangible surface 904. However, alternate embodiments also exist, as shown within for example FIGS. 9F-9G. Within the embodiment of the cap assembly 900 shown in FIGS. 9F-9G, the mechanical structure of the body\stem 918 has shoulders 916 which are rounded rather than squared off as in FIG. 9C, and the frangible surface 904 may be higher than what is shown within FIG. 9C. Depending on manufacturing considerations and potential leakage or pressure changes of the fluid transported within the device incorporating the cap assembly 900, the frangible surface 904 can be raised or lowered.

In an embodiment (see FIG. 9G), transfer ribs 922 can be incorporated into the body\stem 918, to assist in mechanically transferring the force applied by the operators fingers through the finger-areas 908 directly to the frangible surface 904. Further, the body\stem 918 can be shortened (see FIG. 9G), in order to accommodate space constraints or other considerations such as mechanical strength and/or packaging.

Because this embodiment of cap assembly 900 has no equivalent of the seal 312, the various seal issues are eliminated. Within the cap assembly 900, the frangible surface 904 will be more mechanical and less paper- and puncture-oriented. In usage, the effect will be somewhat more like opening a soda can.

Method of Manufacture of Component Parts

The embodiments herein contemplate at least two separate methods of manufacture. The first (the majority of this disclosure) will assume that the entire product, including infant formula, is made and sold in a completely pre-assembled format. That is, where the cap assembly 100, the bottle, and the formula are all packaged and purchased together, and no assembly is required. This embodiment would be sold at grocery or drugstores, ready for purchase and immediate use.

The second embodiment is a re-sealable arrangement, where the bottle and formula may already exist, but the user attaches the cap assembly 100 themselves. Alternately, the bottle may already exist, but the user purchases the formula and cap assembly 100 themselves. Yet another alternate exists in which the bottle and cap are already purchased, but the user inserts their own formula, such as for example from a woman who uses a breast pump and stores her formula for later use. Professional women who have jobs and are thus away from their infant child for periods of time are an example of this. This is known as the "self-administered" embodiment.

Most of the following information applies to both embodiments.

The fitting (canoe) portion 304, base portion 306, outer surface 318, and gripping ring 314 are made from polypropylene or nylon, although other material can be used. Nylon and polypropylene both contain excellent cleanability, can have bacterial treatment added thereto, are suitable for repeat use conditions, and are FDA compliant. Also, nylon in most cases is FDA, USDA and 3A-Dairy compliant.

In an embodiment, the nipple insert 316 is made from silicone or latex, although other material can be used. Silicone is advantageous for being hygienic and hypoallergenic. Its rubber-like material is safe, durable and pliable as there are no open pores to harbor bacteria. Silicone is also easy to use and to clean, is microwave or freezer safe/dishwasher friendly, does not fade or scratch, and is extremely temperature resistant.

In an embodiment, the seal (liner) 312 is made from foil, polypropylene, or paper, although other material can also be used. The pressure sensitive seal 312 prevents contamination and leaks, and preserves leak-proof freshness by sealing liquid in. Various steps can be taken to ensure that, when punctured, the seal 312 does not shred into fragments or segments that can be introduced into the formula-stream. One possible way to address this is to use a component with a molecular structure which has minimal resistance to forces applied perpendicular to the surface, but has stronger resistance to forces applied laterally or in the same plane as the surface. Such a component could be punctured effectively, but would resist tearing and shredding or fragmenting, and thus be less likely to break off into fragments or components that could make their way into the formula-stream itself.

The nipple insert 316 is made from silicone (preferred) or latex. In an embodiment, the nipple insert 316 is manufactured by injecting Liquid Silicone Rubber (LSR) into a closed, heated molds, although other techniques can also be used.

Various of the components described herein (excluding for example the seal (liner) 312) are manufactured using high temperature, pressurized injection molding equipment specifically designed for the material used in each component, and having an operating temperature of 350 to 500 degrees Fahrenheit.

Regarding packaging of the overall product sold, which includes the cap assembly 100 but also (possibly) includes other components, shrink seals can be used to preserve sanitary effectiveness. Shrink seals in general are also known as cut shrink bands, custom cut bands, tamper evident bands, tamper-evident seals, safety seals, cap bands, cap seals, clear bands, or seamless bands.

Shrink seals or shrink bands provide a cost-effective choice for securing caps, lids and closures with easily recognized tamper-evidence. To apply a shrink seal, it is necessary to slide the plastic band sleeve over the capped bottle/jar, and then apply heat with a conventional hairdryer or heat gun.

All components of the described device will be manufactured separately, and combined at various stages, depending on the specific embodiment. These components will then be shipped to an assembly plant where all components will be assembled in a complete unit. At this location, all components are assembled and a heatshrink wrap placed and installed on each completed cap assembly 100. In this arrangement, the cap assembly 100 will contain all pieces except for the fitting 310, which will be installed at the packaging factory.

It is important to note that the nipple assembly 316 is not asserted as being sterilized as part of these processes. A manufacturer selling either the cap assembly 100 as either a solo product or as part of a larger combination will separately arrange for sterilization of the nipple assembly 316.

Illustrated Order of Building\Packaging the Cap Assembly 100

The following steps are partially documented in the flowchart of FIG. 7. First, the gripping 314 and nipple insert 316 are assembled. The base 306 and seal 312 are then assembled, and the seal 312 is glued or adhered in the appropriate location.

The gripping ring 314 (with nipple insert 316 previously installed) is then pressed on to the base 306 (with seal 312 previously installed) very tightly, in order to lock the two assembled components together to create a tight seal. After these two sub-assemblies are mated together, the outer cap 318 is installed onto the complete assembled cap assembly 100.

To assemble the fitting 310 and the gripping ring 314, the gripping ring 314 is inserted over the fitting 310 and rotated, for example, clockwise when viewed from the top, to cause the interior thread 362 of the second exterior tube 352 to engage the ridge 340 of the exterior tube 324. The surface of the exterior tube 352 can have bumps, knurling, surface treatments, and/or other features to facilitate gripping and rotation of the exterior tube 352, and hence the gripping ring 314. When the gripping ring 314 has moved far enough along the fitting 310, the exterior tube 352 will abut the base 322 of the fitting 310, thereby preventing further clockwise rotation of the gripping ring 314 relative to the fitting 310.

In an embodiment, locking tabs or other locking features (not shown) are used to keep the gripping ring 314 secured to the fitting 310 during storage, transportation, and handling until the fluid 130 is to be dispensed.

Once all components are assembled and Quality Assurance (Q/A) verified to be installed correctly, a plastic heat shrink tube is placed over the completed cap assembly 100. Heat is then applied to shrink the material locking the complete assembly together, ready for the installation on the fitting 310.

As stated, there are at least two manufacturing embodiments. The first embodiment is where a baby formula manufacturer packages and sells their baby formula in some type of construction which directly includes the cap assembly 100. The second embodiment is where the cap assembly is sold separately, and the user attaches it to their own pre-existing container for baby formula or milk.

In the embodiment where the completed cap assembly 100 is installed on a package directly containing actual baby formula, the various liquid packaging (shown for example in FIGS. 5 and 6) must first be filled with the target liquid. In an embodiment, this can be completed by using a filling machine that will inject the Liquid directly through the currently installed fitting 510 prior to installation of completed cap assembly 100.

At this point, the fitting (or packaging connector) 510 is installed on the target container, and the container is then filled with liquid formula. The completed cap assembly 100 can then be installed onto any liquid-packaging utilizing the correct fitting 510. In most cases, the completed assembly 100 will be pressed onto the fitting 510, thereby locking the complete assembly together with the liquid container.

Illustrated Method of Use

The following steps are partially documented in the flowchart of FIG. 8. When the time comes to dispense the fluid 130, a user will grasp the outer cap 318 and press the surface 390 inward toward the nipple insert 316. At this point, the interior wall 388 will again abut the dome 382, and presses on the dome 382 until the dome 382 abuts the seal 312 and urges it into engagement with the tapered section 336 of the post 330 of the fitting 310. In response to this pressure, the puncture section 336 may puncture the seal 312, thereby allowing the fluid 130 to flow into the nipple insert 316.

Still using only a single hand, the user then pulls on the outer surface 318 to remove it from the gripping ring 314 and expose the nipple insert 316. Then, the user may grasp the nipple 384 of the nipple insert 316, and simultaneously pull the nipple 384 to return the dome 382 to an in-use configuration, all with one hand. The nipple 384 may then be inserted into an infant's mouth.

Any methods disclosed herein comprise one or more steps or actions for performing the described method. The method steps and/or actions can be interchanged with one another. In other words, unless a specific order of steps or actions is required for proper operation of the embodiment, the order and/or use of specific steps and/or actions can be modified.

In the above description of embodiments, various features are sometimes grouped together in a single embodiment, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

While specific embodiments and applications of the present invention have been illustrated and described, it is to be understood that the invention is not limited to the precise configuration and components disclosed herein. Various modifications, changes, and variations which will be apparent to those skilled in the art are made in the arrangement, operation, and details of the methods and systems of the present invention disclosed herein without departing from the spirit and scope of the invention.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A fluid dispensing system for usage on a pre-purchased vessel in which a user has already installed a fluid of their choice, comprising:

a fitting having a cylindrical outer surface;

an outer cap, wherein the outer cap has a tapered cylindrical shape and is attached to the fitting;

wherein the outer cap has two or more indented finger-areas having parallel grooves embedded therein suitable for a user's fingers to apply pressure; and a body\stem having shoulders that extend outward from the body\stem and a disc-shaped frangible surface base mechanically attached to the fitting, wherein when the user applies finger-pressure force to the indented finger areas, the indented finger areas transfer some of that pressure to the shoulders, which in turn translate that pressure\force to the body\stem, which then carries that force to the frangible surface for rupturing the frangible surface base and allowing fluid stored in the vessel to be admitted therethrough.

2. The fluid dispensing system of claim 1, further comprising:

a cylindrical gripping ring which attaches to the fitting via snap-fit;

a nipple insert located between the gripping ring and the fitting such that the gripping ring holds the nipple insert to be immobile and non-movable; and wherein the outer cap entirely covers the circular seal, cylindrical gripping ring, and nipple insert.

3. The fluid dispensing system of claim 1, wherein the fitting further comprises:

a canoe portion and a base portion, wherein the canoe portion has a vertical surface which is inserted into an aperture formed within a bottom of the base portion.

4. The fluid dispensing system of claim 3, wherein the canoe portion further comprises an attachment fitting having a tubular post, wherein the tubular post has a hollow interior for the movement of fluid contained within the vessel to flow therethrough.

5. The fluid dispensing system of claim 2, wherein the cylindrical gripping ring further comprises a rim, exterior tube, shoulder, and interior flange, wherein the rim encircles the nipple insert and the interior flange retains the nipple insert in place.

6. The fluid dispensing system of claim 1, further comprising:

the shoulders being rounded.

7. The fluid dispensing system of claim 1, further comprising:

the frangible surface base being located nearer to the shoulders than to the fitting.

8. The fluid dispensing system of claim 1, further comprising:

the frangible surface base being located nearer to the fitting than to the shoulders.

9. The fluid dispensing system of claim 1, further comprising:

the finger-areas having gnurled surfaces manufactured therein.

10. The fluid dispensing system of claim 1, further comprising:

the frangible surface base being manufactured to remain secure and uncompromised during manufacturing, assembly, filling, and shipping, but brittle and crackable during use.

11. The fluid dispensing system of claim 10, further comprising:

the frangible surface base being manufactured to compromise crack or rupture only when pressure is applied to the finger-areas and then the shoulders in a way that corresponds with pressure from human fingers, and not from ordinary stresses of shipping, packaging, and being boxed and transported.

12. The fluid dispensing system of claim 1, further comprising:

transfer ribs incorporated into the body\stem to assist in mechanically transferring the force applied by the operators fingers through the finger-areas directly to the frangible surface base.

13. A fluid dispensing system for usage with a vessel in which the combination of system and vessel is sold to consumers with fluid contained therein, comprising:

a fitting having a cylindrical outer surface;

an outer cap, wherein the outer cap has a tapered cylindrical shape and is attached to the fitting;

wherein the outer cap has two or more indented finger-areas having parallel grooves embedded therein suitable for a user's fingers to apply pressure; and a body\stem having shoulders that extend outward from the body\stem and a disc-shaped frangible surface base mechanically attached to the fitting, wherein when the user applies finger-pressure force to the indented finger areas, the indented finger areas transfer some of that pressure to the shoulders, which in turn translate that pressure\force to the body\stem, which then carries that force to the frangible surface for rupturing the frangible surface base and allowing fluid stored in the vessel to be admitted therethrough.

14. The fluid dispensing system of claim 13, further comprising:

a cylindrical gripping ring which attaches to the fitting via snap-fit;

a nipple insert located between the gripping ring and the fitting such that the gripping ring holds the nipple insert to be immobile and non-movable; and wherein the outer cap entirely covers the circular seal, cylindrical gripping ring, and nipple insert.

15. The fluid dispensing system of claim 13, wherein the fitting further comprises:

a canoe portion and a base portion, wherein the canoe portion has a vertical surface which is inserted into an aperture formed within a bottom of the base portion.

16. The fluid dispensing system of claim 15, wherein the canoe portion further comprises an attachment fitting having a tubular post, wherein the tubular post has a hollow interior for the movement of fluid contained within the vessel to flow therethrough.

17. The fluid dispensing system of claim 13, further comprising:

the shoulders being rounded.

18. The fluid dispensing system of claim 13, further comprising:

the frangible surface base being manufactured to remain secure and uncompromised during manufacturing, assembly, filling, and shipping, but brittle and crackable during use.

19. The fluid dispensing system of claim 13, further comprising:

the frangible surface base being manufactured to compromise crack or rupture only when pressure is applied to the finger-areas and then the shoulders in a way that corresponds with pressure from human fingers, and not from ordinary stresses of shipping, packaging, and being boxed and transported.

* * * * *